US008201591B2

(12) United States Patent
Monti

(10) Patent No.: US 8,201,591 B2
(45) Date of Patent: Jun. 19, 2012

(54) METHOD FOR BATCHING POWDER AND/OR GRANULAR PRODUCTS INTERNALLY OF CONTAINER ELEMENTS AND APPARATUS FOR ACTUATING THE METHOD

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 1128 days.

(21) Appl. No.: 12/050,335

(22) Filed: Mar. 18, 2008

(65) Prior Publication Data

US 2008/0236701 A1 Oct. 2, 2008

(30) Foreign Application Priority Data

Apr. 2, 2007 (IT) ..... BO2007A0236

(51) Int. Cl.
*B65B 1/04* (2006.01)

(52) U.S. Cl. ..... 141/81; 141/12; 141/67; 141/237

(58) Field of Classification Search ..... 141/12, 141/67, 69–71, 81, 129, 237
See application file for complete search history.

(56) References Cited

U.S. PATENT DOCUMENTS 2,778,387 A * 1/1957 Diehl ..... 141/84
4,640,322 A 2/1987 Ballester
5,109,893 A * 5/1992 Derby ..... 141/67
5,234,037 A * 8/1993 Derby ..... 141/67
5,244,019 A * 9/1993 Derby ..... 141/71
5,275,215 A * 1/1994 Derby ..... 141/67
5,513,682 A * 5/1996 Derby ..... 141/67
5,531,252 A * 7/1996 Derby et al. ..... 141/67
5,538,053 A * 7/1996 Derby ..... 141/71
5,797,435 A * 8/1998 Wada ..... 141/81
6,021,821 A * 2/2000 Wegman ..... 141/67
6,024,141 A * 2/2000 Wegman ..... 141/129
6,115,028 A * 9/2000 Balakrishnan et al. ..... 345/157
6,182,712 B1 * 2/2001 Stout et al. ..... 141/18
6,340,036 B1 * 1/2002 Toyoizumi et al. ..... 141/275
6,581,650 B2 * 6/2003 Parks et al. ..... 141/12
6,843,282 B2 * 1/2005 Bates et al. ..... 141/12
7,624,771 B2 * 12/2009 Parks et al. ..... 141/67
7,669,617 B2 * 3/2010 Parks et al. ..... 141/67

OTHER PUBLICATIONS

International Search Report.

* cited by examiner

*Primary Examiner* — Gregory Huson
*Assistant Examiner* — Nicolas A Arnett
(74) *Attorney, Agent, or Firm* — William J. Sapone; Coleman Sudol Sapone P.C.

(57) ABSTRACT

An apparatus for batching powder and/or granular products, comprising: a hopper; at least a passage, delimited at one side thereof by a gas-permeable element which alternatively communicates with a first depressed source and with a first pressurized source, and at opposite side thereof communicating with a discharge region; an obturator acting in the passage between an occluding position, in which a batching chamber is defined, and an enabling position. The obturator element is conformed such as to place the hopper in communication with the batching chamber when it is in the occluding position; the first depression source, the first pressurized source and the obturator element being activated in phase relation with one another for loading a batched quantity of powder and/or granular products internally of the batching chamber and for projecting the batched quantity internally of a container element.

9 Claims, 6 Drawing Sheets

METHOD FOR BATCHING POWDER AND/OR GRANULAR PRODUCTS INTERNALLY OF CONTAINER ELEMENTS AND APPARATUS FOR ACTUATING THE METHOD

BACKGROUND OF THE INVENTION

The invention relates to the technical sector of apparatus for batching powder and/or granular products internally of container elements, such as vials or envelopes, for example moving on an advancement line, as well as a method for batching the powder and/or granular products internally of container elements.

U.S. Pat. No. 4,640,322 describes an apparatus for filling container elements with powder products, which can operate in controlled atmospheric conditions; this apparatus comprises: a hopper for containing the powder products; a batching chamber comprising an inlet connected to the hopper, an outlet aligned time by time with respective transiting container elements, and an internal passage having a vertical development; an element which is permeable to gas which superiorly delimits the passage; a discharge valve acting functionally in the passage, below the product inlet, and mobile between an open position and a closed position, in which it respectively enables and prevents communication between the passage and the outlet, with the valve identifying, in the closed position thereof and together with the permeable element, an internal cavity; means for depressing for aspirating a given quantity of product from the hopper through the inlet and internally of the cavity when the valve is in the closed position; pressurized means destined to project the quantity of products, thus loaded internally of the cavity, through the passage outlet and internally of a corresponding container element when the valve is in the open position.

In the region the valve operates in, the portions of the walls delimiting the internal passage are constituted by a deformable elastic membrane; the valve comprises an obturator element destined to act from the outside in a transversal direction to the passage, intercepting and pressing the elastic membrane towards the passage wall facing it; the obturator element thus acts between the closed position, in which the elastic membrane encounters the facing wall of the passage, with a consequent total obstruction of the passage, and the open position in which the internal cavity, due to the elastic reaction of the membrane, is in communication with the outlet of the passage in order to enable transit of the powder products.

Some drawbacks of this solution consist in the rapid deterioration of the elastic membrane and its possible perforation, imputable to the continuous deformation stress the membrane is subjected to during apparatus functioning; this requires frequent substitutions of the membrane, all of which limits the apparatus productivity and in any cases reduces its reliability.

The above-described apparatus enables adjustment of the relative position of the permeable element internally of the passage, such that it is possible to define the quantity of powder products which must be loaded in the cavity and thus the batch thereof destined to be introduced into a corresponding container element; during the loading stage, however, an unknown quantity of product, variable for each operative cycle, falls into the volume identified between the inlet and the underlying deformed elastic membrane (obturator element in the closed position). In consequence of this, the quantity of product projected into the underlying container elements can deviate quite noticeably from the requested amount; this represents a particularly disqualifying drawback in applications where the tolerances are very low, for example when the products are particularly expensive (for example: cosmetic products) or are for medical use.

A further drawback of the above-described apparatus is that it is impossible to reproduce identical operating cycles, in particular to constantly generate a same jet of compressed gas for projecting a batched quantity, priorly loaded into the int4rnal cavity, internally of a corresponding container element; indeed, the projection of each jet of compressed gas is done by timed activation of a solenoid valve, functionally connected to the pressurized source, which exhibits, as an intrinsic characteristic, variable response times.

SUMMARY OF THE INVENTION

In the light of the above drawbacks, an aim of the present invention consists in providing an apparatus for batching powder and/or granular products internally of container elements, which is able to resolve the drawbacks of the known-type solutions, for example of the type described herein above, and which is able to operate in controlled atmospheres; in other words an aim of the invention is to provide a new-concept apparatus which is reliable, functional, which enables high-speed production and which fills corresponding container elements with batched quantities of predetermined products distinguished by having low tolerance, thus enabling the apparatus of the invention to be used in the cosmetic and pharmaceutical industries.

A still further aim of the present invention consists in providing an apparatus which enables projection of bathed quantities of powder and/or granular products internally of corresponding container elements by means of compressed gas jets of the same entity for each operating cycle of the apparatus, so that each cycle can be reproduced substantially in the same operative conditions.

A further aim of the present invention consists in providing a batching apparatus the costs of which are relatively contained with respect to the advantages it aims to guarantee.

A further aim of the present invention consist in providing a method for batching powder and/or granular products internally of container elements, which is of new-concept distinguished by simple and essential stages, which container elements also guarantee high productivity standards, can be used in controlled atmospheres and the actuation costs of which are relatively contained with respect to the advantages it provides.

The above-stated aims are attained in agreement with an apparatus for batching powder and/or granular products, of a type comprising: a hopper for containing the powder and/or granular products; at least a passage, at a side thereof delimited by an element which is permeable to gas which element in turn communicates, with consent of control organs, alternatively with a first depression source and a first pressurized source, and at opposite side thereof communicating with a discharge region of the powder and/or granular products into a corresponding container element, characterized in that it comprises an obturator element action in a the passage in a substantially transversal direction with respect to a development of the passage, between an occluding position of the passage, in which a batching chamber is defined between the obturator element and the permeable element, and a position enabling transit of the powder and/or granular products towards the discharge region, the obturator element being conformed to place the hopper in functional communication with the batching chamber when in the occluding position, the first depression source, the first pressurized source and the obturator element being activated in a suitable reciprocal phase relation in which a batched quantity of the powder and/or granular products is loaded into the relative batching chamber and in which follows the projection of the batched quantity along the passage and towards the discharge region.

BRIEF DESCRIPTION OF THE DRAWINGS

The characteristics of the invention that do not emerge from the above will be better described herein below, in agreement with what is set out in the claims and with the aid of the accompanying figures of the drawings, in which:

DESCRIPTION OF THE PREFERRED EMBODIMENTS

Figure 1A:
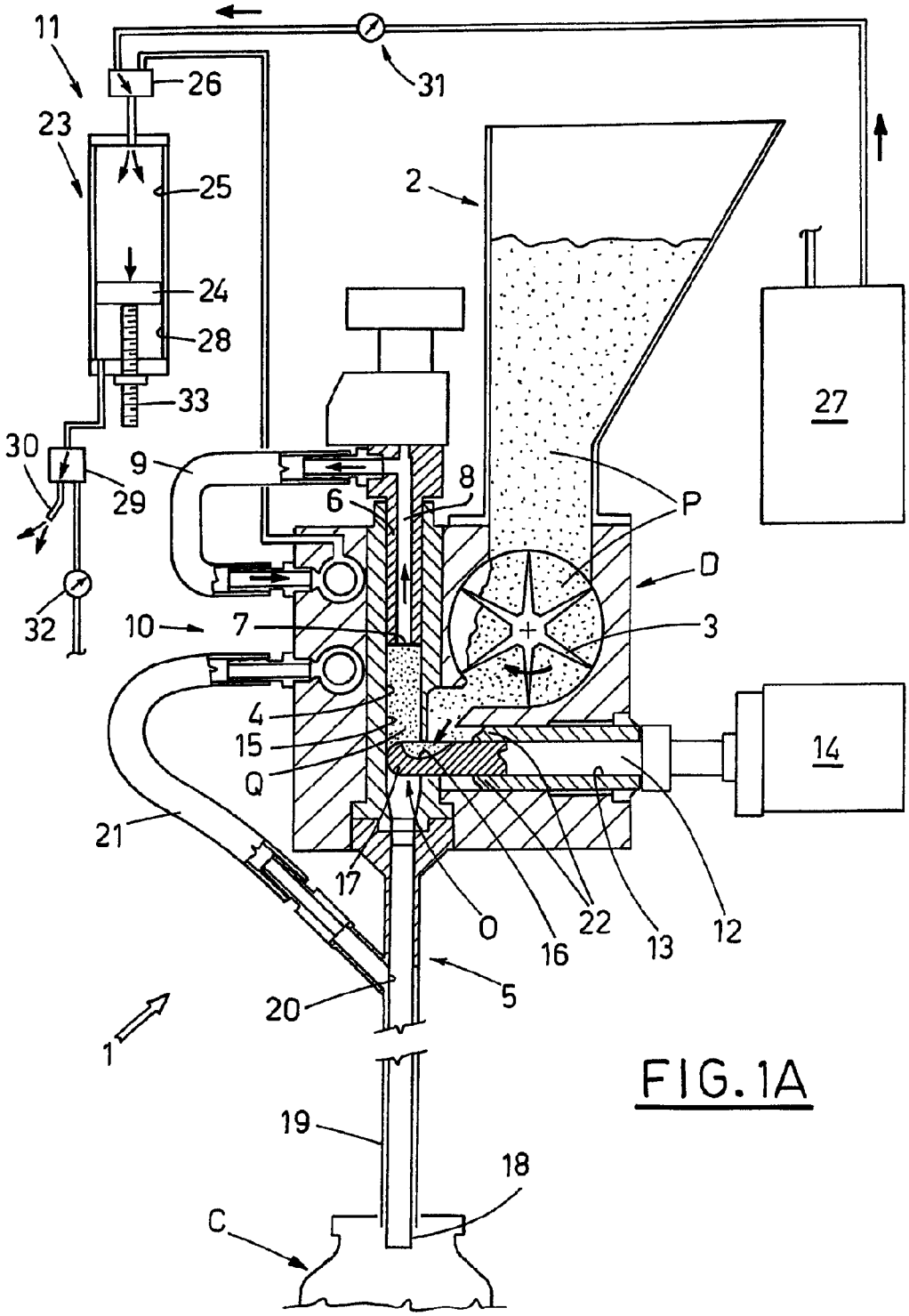
FIGS. 1A, 1B and 1C are corresponding schematic side views of the apparatus of the invention, partially sectioned, in three operating configurations of particular significance.

With reference to the figures of the drawings, 1 denotes in its entirety the apparatus of the invention, which overlies a transporter (not illustrated) of N rows arranged side-by-side (also not illustrated) of container elements C each destined to receive internally thereof a corresponding batched quantity Q of powder and/or granular products supplied by the apparatus 1 itself. In a known way to an expert in the sector, the apparatus 1 and the transporter are activated in mutual phase relation: by way of example, in the following description it will be supposed that the apparatus 1 is fixed, constrained to a frame (not illustrated), while the transporter moves intermittently and cooperatingly with known organs for raising each series of N container elements C transversally arranged, passing one by one below the apparatus 1 during the insertion stage of the powder and/or granular products into them.

The apparatus 1 is substantially constituted by a hopper 2 containing powder and/or granular products and by N batcher units D, served by the hopper 2, which units are functionally identical and arranged side by-side, the units being destined to project corresponding batched quantities Q of products internally of respective N container elements C of an underlying series, in phase relation with the advancing of the transporter, as previously mentioned. Taking this into account, the following description will make reference, for the sake of simplicity, to a generic batcher unit D.

The loading hopper 2 of powder and/or granular products internally comprises, at the lower part thereof, an intermittently-operated star valve 3, which develops substantially over the whole expanse of the apparatus 1, transversally with respect to the advancing of the container elements C.

4 denotes a passage, having a cylindrical conformation and a vertical development, which is inferiorly connected to a vertical discharge conduit 5 of the powder and/or granular products P and is delimited superiorly by a diaphragm 7 of gas-permeable material fixed to a cursor 6 adjustable at different positions, either automatically or by an operator; the diaphragm 7 communicates via an internal channel 8 and an external channel 9, connected to one another, with a three-way valve (not illustrated in the figures), which is in turn connected to a first depression source 10 and a first pressurized source, in the present example represented by a unit denoted in its entirety by 11.

12 denotes an obturator element which freely engages a suitable housing 13 and is subjected to actuator organs 14 destined to move the obturator alternatingly along the horizontal development axis thereof, between an occluding position O of the passage 4, in which a batching chamber 15 is defined between the obturator 12 and the diaphragm 7, and an enable position K for the transit of the powder and/or granular products P towards the discharge conduit 5; in the example, the obturator element 12 affords a recess 16 at the lateral surface thereof, in proximity of the head 17, which sets the hopper 2 in communication with the batching chamber 15 when the obturator element 12 is in the occluding position O (FIG. 1A), as will emerge from the following. The connection of the hopper 2 with the recess 16 is obtained by means of an entry conduit 34 realized at the lower part of the hopper 2 itself.

Scraper elements 22 are specially fixed at the peripheral portion of the housing 13 exposed to the powder and/or granular products P coming from the hopper 2, with the aim of preventing particles of the products P from insinuating themselves between the housing 13 and the obturator element 12 during the alternating motion thereof, which might compromise the functioning thereof.

The discharge conduit 5 functionally terminates with a relative nozzle 18.

The apparatus 1 includes a tubular element 19 which encompasses the discharge conduit and is concentric thereto, identifying an annular space; an opening 20 is also afforded which sets the annular space in communication with a depression source via an aspiration conduit 21. In the illustrated embodiment, however, the depression source is the first depression source 10.

The unit 11 comprises a cylinder 23 containing a piston 24, defining: a first chamber 25 communicating, via functional interposing of a three-way valve 26, respectively with the diaphragm 7 via the conduit 9 and with a second pressurized source 27; and a second chamber 28 communicating, via functional interposing of a three-way valve 29, respectively with a third pressurized source, not shown in the figures, and with a discharge 30. A stop 33 for the piston 24, adjustable at distinct positions by the operator or automatically, defines the maximum expansion value which can be assumed by the first chamber 25 during the functioning of the unit 11.

By way of example, in the enclosed figures numbers 31, 32 denote pressure adjustment devices of known type interposed respectively between the second pressurized source 27 and the three-way valve 26 and between the third pressurized source and the three-way valve 29.

There follows a description of the functioning of a cycle of the apparatus of the present invention, with reference to a generic batching unit D, similar considerations being taken to count for other remaining batching units, given the identical nature of the structural and functional characteristics which distinguish the units D.

FIG. 1A schematically illustrates the stage of introduction and aspiration of the powder and/or granular products P internally of the batching chamber 15, in which the three-way valve (as mentioned not shown in the figures) places the batching chamber 15 in communication with the first depression source 10 and the obturator element 12 is in the occluding position O: the products P are pushed by the hopper 2 towards the batching chamber 15, across the recess 16 made in the obturator element 12, following the step action of the star valve 3 and are there compacted by the aspirating action of the first depression source 10 exerted through the permeable diaphragm 7; this causes a filling of the whole volume of the batching chamber 15 with powder and/or granular products P. The compacted quantity of the products P in the volume of the batching chamber 15, defined after adjusting the cursor 6 position, defines once and for all (differently to the prior art) the batch Q of products P destined to be introduced internally of a corresponding container element C.

The occluding position O assumed by the obturator element 12 has also been illustrated in larger scale in FIG. 3A, though with reference to a variant embodiment which will be discussed herein below; in this configuration the head 17 of the obturator 12 presses against a corresponding opposite portion of the delimiting wall of the passage 4, completely obstructing it.

There follows the movement of the obturator element 12 into the enabling position K by means of the actuator organs 14 (FIG. 1B), which resets communication between the batching chamber 15 and the discharge conduit 5 of the powder and/or granular products P; the aspirating action exerted by the first depression source 10, exerted through the diaphragm 7, stably retains the batch Q of powder and/or granular product P in the batching chamber 15 for the time necessary for the obturator element 12 to slide along the relative housing 13 towards the enabling position K. In phase relation with the displacement of the obturator element 12 the three-way valve is switched, placing the batching chamber 15 in functional communication with the first pressurized source 11, and follows the activation of the first pressurized source 11 (in a way which will be described herein below) with a consequent projection of the batched quantity Q through the discharge conduit 5 (FIG. 1B) up to the inside of the corresponding container element C (FIG. 1C). In phase relation with the transit of the batched quantity Q of powder and/or granular products P along the discharge conduit 5, a depression is established at the mouth of the container element C thanks to the aspirating action of the first depression source 10 acting through the aspiration conduit 21 and through the annular space, which is defined, as specified above, between the tubular element 19 and the discharge conduit 5; the depression advantageously both facilitates a more rapid descent of the batched quantity Q along the discharge conduit 5 and internally of the container element C, and is also of such an entity as to enable aspiration of the suspended powders generated during the filling thereof. This is a detail of very appreciable importance when the apparatus 1 of the invention is operating in controlled atmosphere environment, in which it is very important that the products introduced into the container elements C are not in any way diffused to the outside.

The compacted powder and/or granular products P which remain imprisoned in the recess 16 of the obturator 12 following the aspirating operation of a batched quantity Q internally of the batching chamber 15, are destined to be conveyed into the batching chamber 15 during the following operating cycle of the apparatus 1.

The enable position K assumed by the obturator element 12 is shown in FIGS. 1B, 1C, and is shown again in large scale in FIG. 3B, though with reference to a variant embodiment which will be better discussed herein below; in this configuration the head 17 of the obturator 12 occupies the passage 4 only marginally, without its compromising the discharge operation of the batched quantity Q of the batching chamber 15 internally of the corresponding container element C; obviously the apparatus 1 can be made such that the obturator 12, in the enable position K, does not interfere with the passage 4.

During the return of the obturator 12 towards the enable position K (FIG. 1B), the scraper elements 22 retain the powder and/or granular products P in the entry conduit 34; this advantageously prevents any particles of the products P from insinuating themselves between the obturator element 12 and the relative housing 13 during the alternating motion of the obturator 12, which would compromise the functioning thereof.

Once the container C element has been filled (FIG. 1C), the actuator organs 14 move the obturator element 12 newly into the occluding position O (FIG. 1A) and in suitable phase relation the star valve 3 is actuated and the three-way valve switched to place the diaphragm 7 in communication with the first depression source 10; thus a new aspirating operating cycle begins and a batched quantity Q of powder and/or granular product P is introduced into the batching chamber 15 and projected into a successive container element C.

Still with reference to FIGS. 1A, 1B, 1C there follows the description of the operating stages which distinguish the functioning of the first source or pressure unit 11, which are obviously destined to happen in suitable phase relation with the operating cycle of the apparatus 1 in its entirety, as described herein above.

The first pressurized source 11 operates to project a compressed gas jet, contained internally of the first chamber 25, contemporaneously through the passage 4 of each batching unit D, in order to realize the discharge of a batched quantity Q of powder and/or granular products P, priorly loaded into the relative batching chamber 15, internally of a corresponding container element C.

Figure 1B:
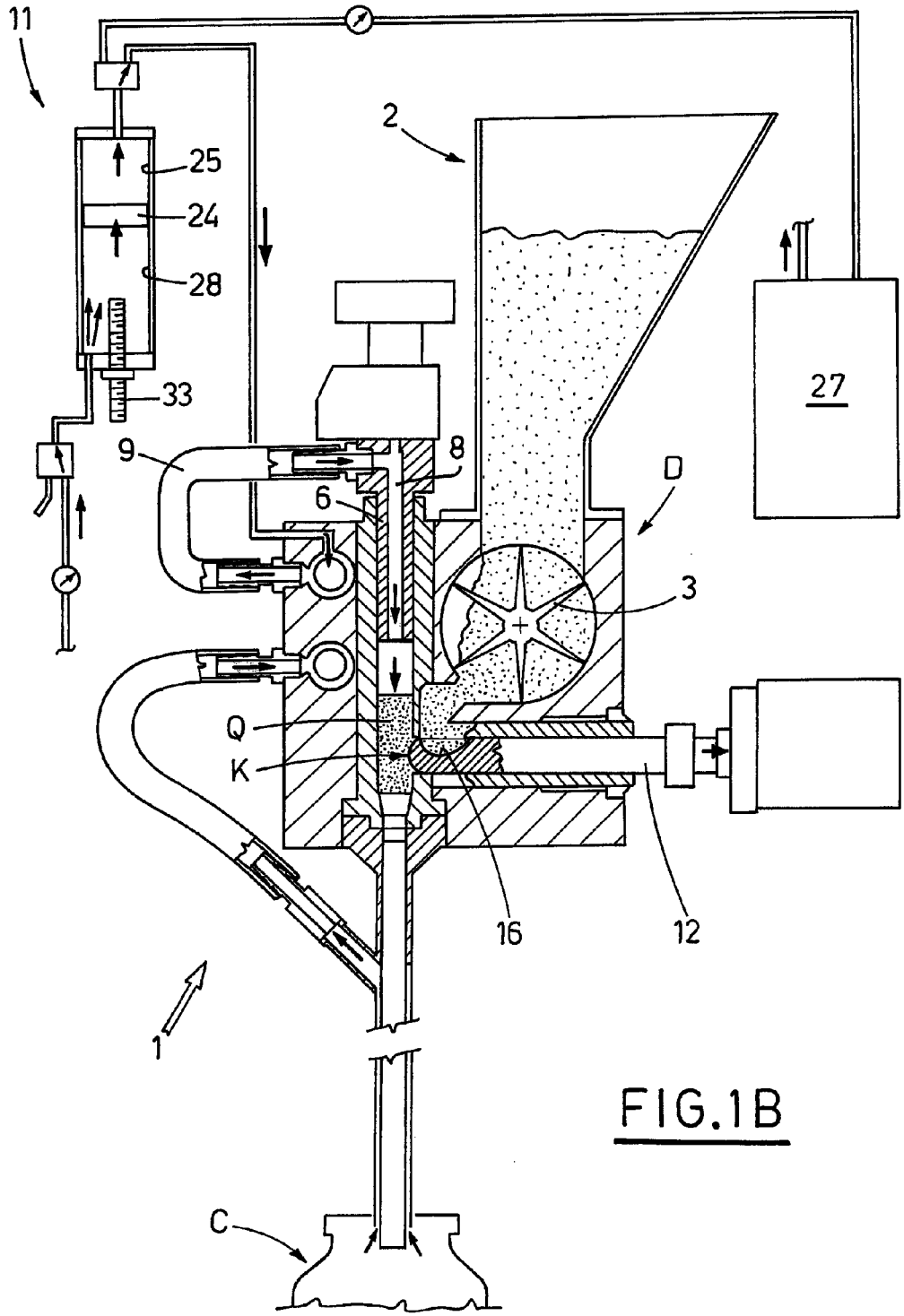
Figure 1C:
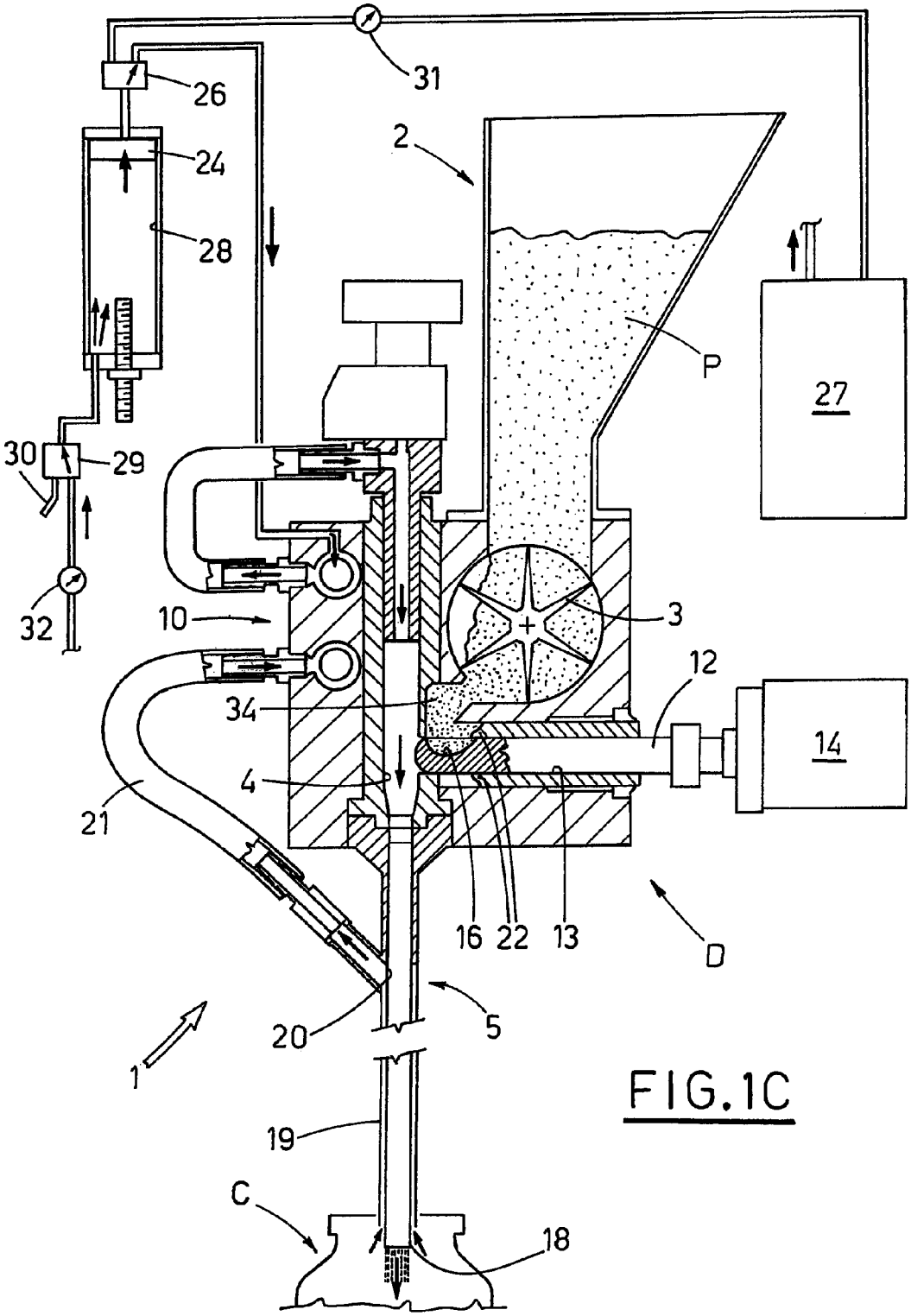

The operative stages which distinguish the functioning of the pressure unit 11 comprise: the activating of the three-way valves 26, 29 in order to place in communication, respectively, the second pressurized source 27 with the first chamber 25 and the discharge 30 with the second chamber 28, with a consequent filling of the first chamber 25 with gas at a determined pressure (which is adjustable by means of the adjusting device 31), to determine the displacement of the piston 24 against the stop 33 and the expulsion of the fluid contained in the second chamber 28 through the discharge 30 (FIG. 1A); the activation of the three-way valves 26, 29 in order respectively to set the first chamber 25 in communication with the batching chamber 15 of each batching unit D and the third pressurized source in communication with the second chamber 28, with a consequent conveying of fluid at high pressure (which is adjustable by means of the pressure adjusting device 32) internally of the second chamber 28 and generation of a corresponding force on the piston 24 which causes the projection of the gas contained internally of the first chamber 25 through the passages 4 of the respective batching units D, in the operating configurations of the apparatus 1 as already explained herein above (FIGS. 1B, 1C).

It is therefore possible to fill the first chamber 25 with a quantity of gas at the desired pressure (thanks to the presence of the adjustment device 31), define the maximum expansion volume of the first chamber 25 (adjusting the position of the stop 33) and thus the volume of gas destined to be sharedly conveyed through the passages 4 of the batching units D, and finally establish the fluid pressure which has to be conveyed into the second chamber 28 (thanks to the presence of the adjustment device 32) i.e. the force which has to activate the piston 24; in this way the pressure unit 11 can operate flexibly, adapting itself advantageously to the production needs of the apparatus 1. Further, each operating cycle of the unit 11 is repeated in the same operative conditions, in the sense that once the above-mentioned adjustments have been performed, a compressed gas jet of a prefixed volume (equal to the maximum expansion volume of the first chamber 25) is projected; in the known-type solutions, the projection of a compressed gas jet was done via timed activation of a solenoid valve which was functionally connected to the pressurized source, which due to intrinsic characteristics thereof has variable time-responses.

It is stressed, in addition, that the violent projection of a relative jet of compressed gas along the passage 4 of each batching unit D, in the above-described ways, completely frees and cleans the diaphragm 7 surface which time by time b in contact with the powder and/or granular products P during the stage of loading thereof into the batching chamber 15; the stage of aspiration of the powder and/or granular products P internally of the batching chamber 15 is thus always done optimally.

In the light of the above there follows a description of the method for batching powder and/or granular products P internally of the container elements C, also object of the present invention, which substantially comprises:

loading, by means of aspiration, a batched quantity Q of powder and/or granular products P internally of the batching chamber 15, through the recess 16 when the obturator element 12 is in the occluding position O;

the projection of the batched quantity Q through the discharge conduit 5 and towards the inside of a corresponding container element C, in phase relation with the movement of the obturator element 12 into the enable position K of transit of the batching powder and/or granular products P by application of a first compressed gas jet;

the application, in phase relation with the above-cited projection, of a depression at the mouth of the container element C, such as to accelerate the motion of the batched quantity Q transiting towards the inside of the container element C.

The aspiration of the suspended powders contextually with the filling of the container element C prevents exit of the product to the outside; this detail is very advantageous indeed in a case of actuation of the method in controlled atmosphere environments, in which it is of fundamental importance to maintain highly aseptic and clean conditions.

In the light of the above, it is clear that the apparatus of the invention fully satisfies the predetermined aims, given that it can be advantageously used in sterile environments (to this end inert compressed gases are used), is reliable, compact and guarantees high standards of productivity with respect to the solutions of known type, thanks to the modular realization thereof in a plurality of batching units D; further, the apparatus 1 is intrinsically versatile, functional and adaptable to the most varied production needs; it can, in fact, be easily integrated or deprived of one or more batching units D according to needs, and permits to define quickly the batched quantity Q in a wide available range of values by adjusting the position of the cursor 6 and even including several loading operations internally of a same container element C. Furthermore, the apparatus of the invention supplies corresponding container elements C with batched quantities Q of predetermined products, distinguished by minimum tolerances, thus also enabling the use of the apparatus in the cosmetic and pharmaceutical industries.

A further advantage of the invention consists in having defined an apparatus the costs of which are relatively contained with respect to the advantages obtained.

A still further advantage of the present invention consists in having defined a method for batching powder and/or granular products which is very advantageously actuable in controlled atmosphere environments, is simply operated, guarantees high productivity standards and has relatively contained costs with respect to the advantages offered.

Figure 2A:
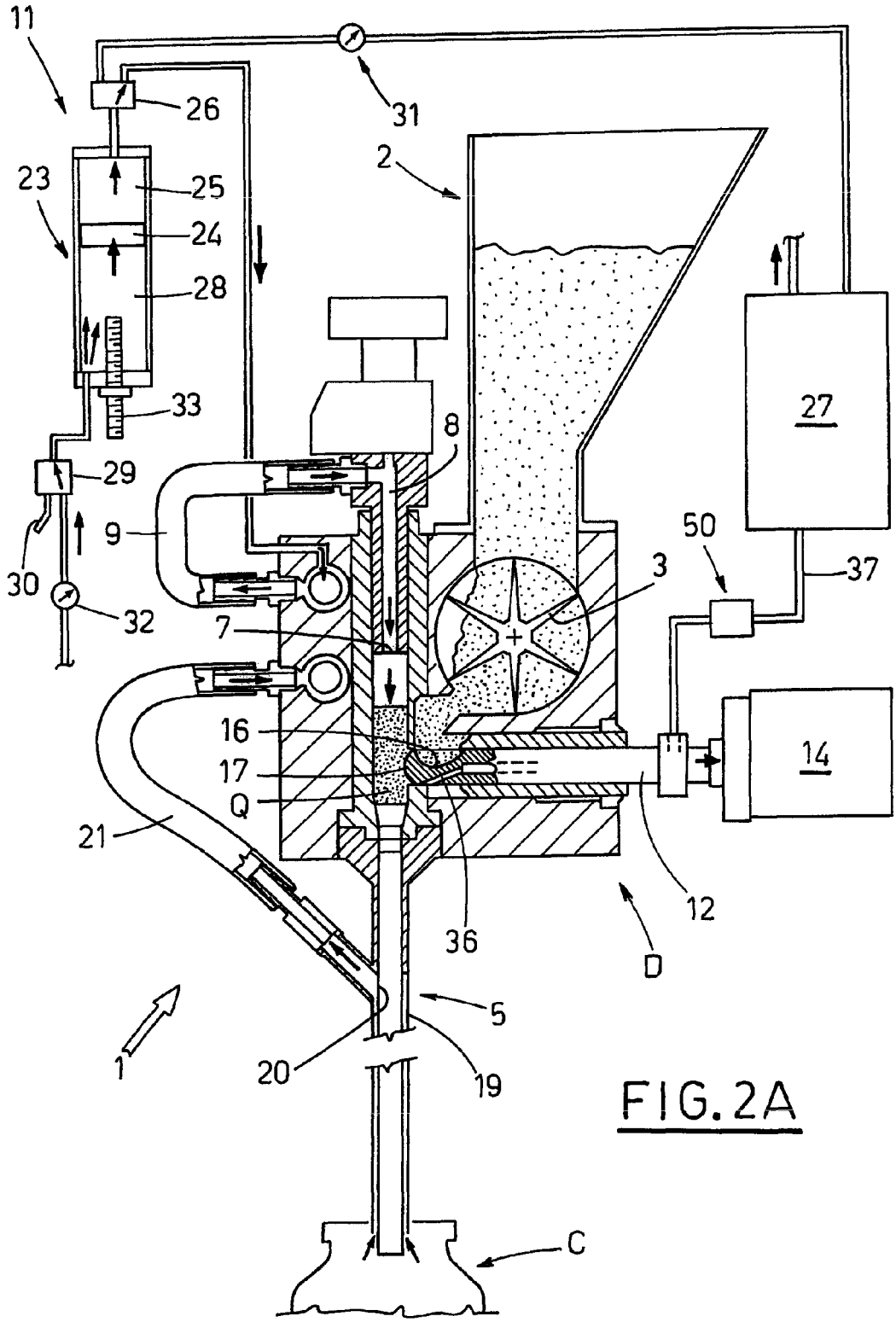
FIG. 2A, 2B are corresponding schematic side views of the apparatus of the invention, partially sectioned, in two operating configurations of particular significance, in a variant of the invention.
Figure 2B:
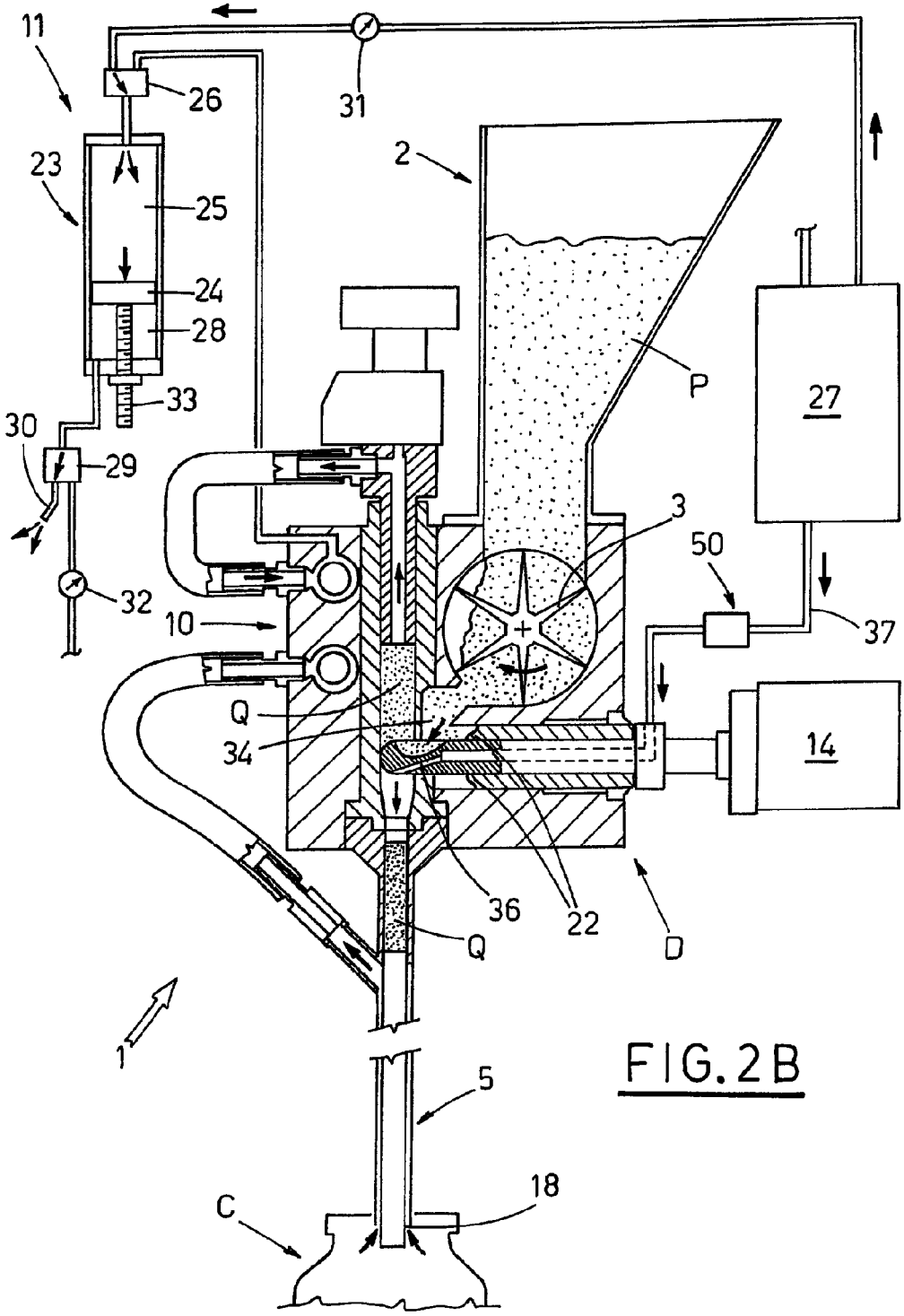

A variant of the apparatus 1 has been illustrated in FIGS. 2A, 2B, which illustrate a batching unit D of the apparatus 1 in two significant operating stages; FIGS. 3A, 3B, on the other hand, are large-scale illustrations of a same detail, respectively from FIGS. 2A, 2B. With respect to the embodiment first described, the variation enables: a reduction in cycle times and thus a consequent increase in productivity; or a considerable increase in the time available for filling the batching chamber 15, should this be rendered necessary due to the characteristics of the powder and/or granular products P used.

Figure 3A:
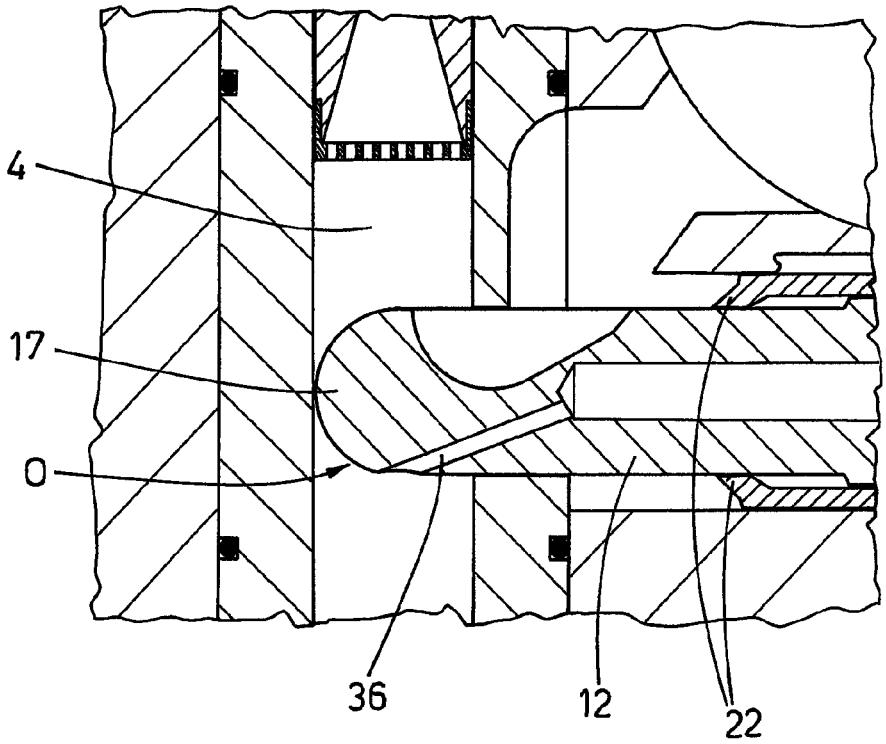
FIGS. 3A, 3B illustrate an enlarged detail respectively of FIGS. 2A and 2B.
Figure 3B:
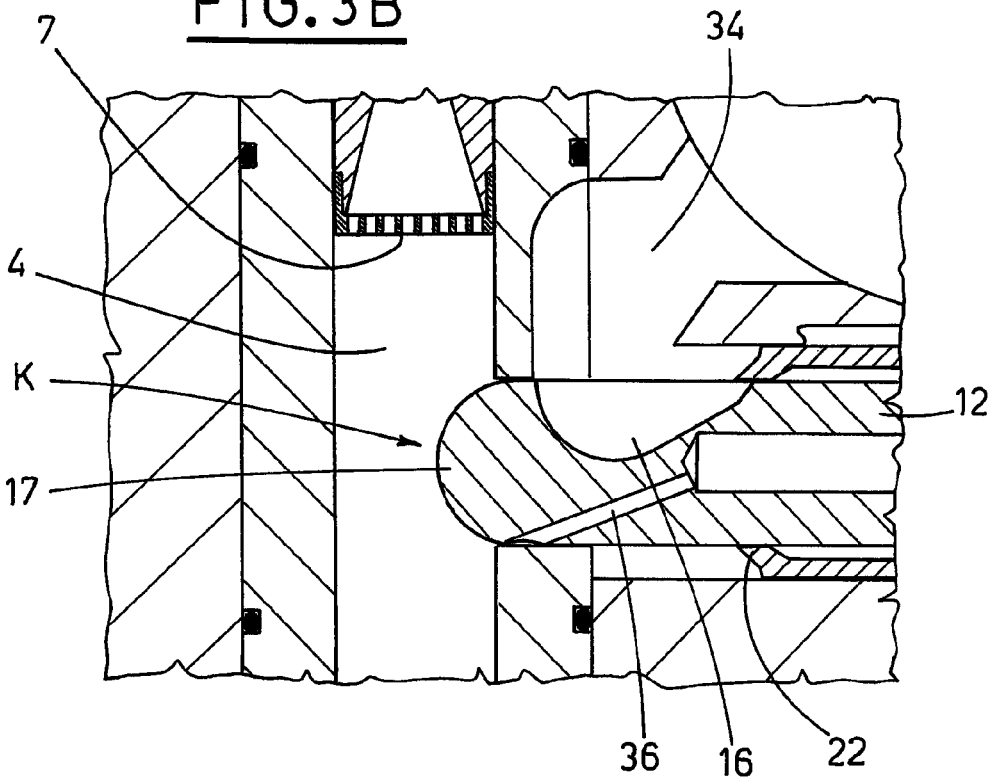

This is obtained by placing, for example, the second pressurized source 27 in functional communication also with the discharge conduit 5, when the obturator element 12 is in the occluding position O and with enabling consented by a valve 50, by means of a conduit 37 connected to an auxiliary channel 36 afforded internally of the obturator element 12; the auxiliary channel 36 has a development such as to enable communication of the second pressurized source 27 with the discharge conduit 5 only when the obturator element 12 is in the occluding position O illustrated in FIGS. 2A, 3A.

The functioning of the apparatus 1 according to the variant embodiment can be described starting from the operating configuration schematically illustrated in FIG. 2A, in which the transit of a batched quantity Q of powder and/or granular products P along the passage 4 is illustrated, when the obturator 12 is in the enable position K; as in the above-described embodiment, during this stage the batched quantity Q is subjected to a compressed gas jet generated by the first pressurized source 11. Once the batched quantity Q has crossed the passage portion 4 in which the obturator element 12 acts, there immediately follows the movement of the obturator element 12 into the occluding position O, which as has been mentioned sets the second pressurized source 27 in communication with the discharge conduit 5 through the auxiliary channel 36 and the conduit 37; in phase relation with the movement of the obturator element 12 into the occluding position O, the batched quantity Q in transit is subjected to a second compressed gas jet, by the second pressurized source 27, and the star valve 3 is activated and the three-way valve switched (not illustrated) to cause loading of a new batched quantity Q internally of the batching chamber 15, see FIG. 2B. The batched quantity in transit along the discharge conduit 5 is thus introduced into the underlying container element C, together with the application of an aspirating action at the mouth thereof, similar to what is described for the first embodiment of the apparatus 1. The second compressed gas jet, then, accelerates the motion of the batched quantity Q in transit along the discharge conduit 5 up to the entry thereof into the corresponding container element C, even following the reaching of the obturator element 12 into the relative occluding position O.

The discharge stage of the quantity Q of powder and/or granular products P is done contemporaneously with the stage of loading into the batching chamber 15, FIG. 2B, advantageously causing a reduction in the cycle time of the apparatus 1 with respect to the first described embodiment; the batched quantity Q in transit downstream of the obturator element 12 along the passage 4 and the discharge conduit 5 is thus pushed at a high speed into the corresponding container element C thanks to the combined action of the first jet of compressed air generated by the first pressurized source 11, the second compressed air jet generated by the second pressurized source 27 as well as the aspirating action exerted at the mouth of the container element C of the first depression source 10.

It is specified that in the above-described variant of the apparatus 1, all the advantageous technical-functional aspects of the first described solution survive; in addition, there is: a significant increase in productivity, due to the reduction of the cycle time; or a considerable increase in time available for filling the batching chamber 15, should this be rendered necessary by the characteristics of the powder and/or granular products P used.

The functioning of the apparatus of the described variant embodiment is defined by the actuation of the method for batching powder and/or granular products, as described above, substantially with the addition of a further operating stage; for the sake of clarity, all the stages of the method are now listed out, as follows:

loading, by means of aspiration, a batched quantity Q of powder and/or granular products P internally of the batching chamber 15, through the recess 16 when the obturator element 12 is in the occluding position O;

the projection of the batched quantity Q through the discharge conduit 5 and towards the inside of a corresponding container element C, in phase relation with the movement of the obturator element 12 into the enable position K of transit of the batching powder and/or granular products P by application of a first compressed gas jet;

the application of a second compressed gas jet on the batched quantity Q transiting along the discharge conduit 5 in phase relation to the activating of the obturator element 12 in the occluding position O;

the application, in phase relation with the above-cited projection, of a depression at the mouth of the container element C, such as to accelerate the motion of the batched quantity Q transiting towards the inside of the container element C.

The above method describes the essential operating stages of the variant of the apparatus 1, while preserving, with respect to the method of the first embodiment of the apparatus 1, all the advantageous technical-function aspects; in addition, the actuation of the method enables a further increase in productivity to be obtained, i.e. a considerable increase in the time available for filling the batching chamber 15, whenever this becomes necessary due to the characteristics of the powder and/or granular products P used, as has already been explained.

It is specified that in place of the recess 16 afforded in the obturator element 12 for setting the hopper 2 in functional communication with the batching chamber 15 when the obturator element 12 is in the occluding position O, a relative internal channel could be afforded, realized in the obturator element 12.

The above is described by way of non-limiting example, and any variations of a practical-applicational nature are considered to fall within the protective ambit of the invention as described herein above and as claimed herein below.

What is claimed:

1. An apparatus for batching powder and/or granular products comprising:

a hopper for containing the powder and/or granular products;

at least one passage, at a side thereof delimited by an element which is permeable to gas which element in turn communicates, with consent of control organs, alternatively with a first depression source and a first pressurized source, and at an opposite side thereof communicating with a discharge region of the powder and/or granular products into a corresponding container element;

an obturator element acting in the passage in a substantially transversal direction with respect to a development of the passage, between an occluding position of the passage, in which a batching chamber is defined between the obturator element and the permeable element, and a position enabling transit of the powder and/or granular products towards the discharge region, the obturator element being conformed to place the hopper in functional communication with the batching chamber when in the occluding position, the first depression source, the first pressurized source and the obturator element being activated in a suitable reciprocal phase relation in which a batched quantity of the powder and/or granular products is loaded into the batching chamber and the following projection of the batched quantity along the passage and towards the discharge region; and, wherein the obturator element is activated by actuator organs of alternated motion parallel to a longitudinal development axis, the obturator element having a recess or an internal channel on an upper lateral surface thereof, in proximity of a head thereof, for placing the hopper in communication with the batching chamber when the obturator element is in the occluding position.

2. The apparatus of claim 1, wherein the discharge region comprises a discharge conduit terminating at a nozzle for discharging the powder and/or granular products internally of a container element and further comprising a second pressurized source communicating with the discharge conduit, destined to be activated in phase relation with the movement of the obturator element into the occluding position, in order to dispense a compressed gas jet along the discharge conduit aimed at accelerating the motion of a corresponding batched quantity transiting towards the inside of the container element.

3. The apparatus of claim 1, wherein the discharge region comprises a discharge conduit terminating at a nozzle for discharge of the powder and/or granular products internally of a container element and wherein the obturator element also exhibits, afforded internally thereof, an auxiliary conduit communicating at a side thereof with a second pressurized source and at another side thereof with the discharge conduit when the obturator element is at least in proximity of the occluding position, the second pressurized source being destined to be activated in phase relation with the motion of the obturator element in the occluding position in order to dispense a compressed gas jet along the discharge conduit or accelerating a motion of a batched quantity transiting towards the inside of the container element.

4. The apparatus of claim 1, wherein the discharge region comprises a discharge conduit terminating at a nozzle for discharge of the powder and/or granular products internally of a container element and further comprising a second depression source functionally associated, via a relative aspiration conduit to the discharge conduit and destined to be activated in phase relation with the projection of the powder and/or granular products internally of the corresponding container element in order to realize a local depression at least at the opening of the container element, which contributes to accelerating the motion of a corresponding batched quantity transiting towards the inside of the container element.

5. The apparatus of claim 4, further comprising a tubular element, which: contains at least the lower terminal portion of the discharge conduit and is substantially concentric thereto in order to identify there-with an annular space; and wherein the tubular element is in communication with the aspiration conduit via a through-hole afforded in a lateral surface thereof, with a consequent definition of a functional connection of the second depression source, via the aspiration conduit and the annular space, with the container element.

6. The apparatus of claim 1, wherein the first pressurized source is a unit comprising a cylinder containing a piston, defining: a first chamber communicating, by functional interposition of first valve organs, with the gas-permeable element and with a second pressurized source; and a second chamber communicating, by functional interposition of second valve organs, with a third pressurized source and with a discharge, the second pressurized source being destined to fill the first chamber with a gas at a predetermined pressure and the third pressurized source being destined to convey a pressurized fluid internally of the second chamber, in the operating stages, in order to convey the gas contained internally of the first chamber, by means of movement of the piston, through the permeable wall, thus projecting the batched quantity located in the batching chamber along the passage and towards the discharge region.

7. The apparatus of claim 6, further comprising a stop for the piston, defining a volume of maximum expansion of the first chamber.

8. The apparatus of claim 7, wherein the stop is adjustable into distinct positions in order to vary the volume of maximum expansion of the first chamber.

9. The apparatus of claim 1, wherein the hopper internally comprises a star valve intermittently activated in phase relation with the activation of the first depression source, the first pressurized source and with the activation of the obturator element, for conveying the powder and/or granular products contained internally thereof towards the batching chamber in the operating stages.

* * * * *